US005681355A

United States Patent [19]

Davis et al.

[11] Patent Number: 5,681,355

[45] Date of Patent: *Oct. 28, 1997

[54] HEAT RESISTANT DRY CLEANING BAG

[75] Inventors: Maxwell Gregory Davis, Forest Park; Bradford Scott Barron, Cincinnati; Andrew Julian Wnuk, Wyoming; Julius Saslow, West Chester, all of Ohio

[73] Assignee: The Procter & Gamble Company, Cincinnati, Ohio

[ * ] Notice: The term of this patent shall not extend beyond the expiration date of Pat. No. 5,547,476.

[21] Appl. No.: 694,136

[22] Filed: Aug. 8, 1996

Related U.S. Application Data

[60] Provisional application No. 60/002,167 Aug. 11, 1995 and 60/005,684 Oct. 17, 1995.

[51] Int. Cl.[6] ..... D06L 1/00; D06L 1/02

[52] U.S. Cl. ..... 8/137; 8/142; 510/281; 510/285; 510/287; 510/289; 510/295; 510/297

[58] Field of Search ..... 8/137, 142; 510/281, 510/285, 287, 289, 297, 295

[56] References Cited

U.S. PATENT DOCUMENTS

| | | | |
|---|---|---|---|
| 1,747,324 | 2/1930 | Savitt . | |
| 3,432,253 | 3/1969 | Dixon et al. . | |
| 3,591,510 | 7/1971 | Zenk . | |
| 3,593,544 | 7/1971 | Henderson . | |
| 3,647,354 | 3/1972 | Loeb . | |
| 3,737,387 | 6/1973 | Marple . | |
| 3,764,544 | 10/1973 | Haworth . | |
| 3,882,038 | 5/1975 | Clayton et al. . | |
| 3,907,496 | 9/1975 | Néel et al. . | |
| 3,949,137 | 4/1976 | Akrongold . | |
| 3,956,556 | 5/1976 | McQueary . | |
| 4,007,300 | 2/1977 | McQueary . | |
| 4,097,397 | 6/1978 | Mizutani et al. . | |
| 4,102,824 | 7/1978 | Mizutani et al. . | |
| 4,115,061 | 9/1978 | Grünewälder . | |
| 4,126,563 | 11/1978 | Barker . | |
| 4,130,392 | 12/1978 | Diehl et al. . | |
| 4,139,475 | 2/1979 | Schwadtke et al. . | |
| 4,336,024 | 6/1982 | Denissenko et al. . | |
| 4,395,261 | 7/1983 | Lutz . | |
| 4,606,842 | 8/1986 | Keyes et al. . | |
| 4,659,496 | 4/1987 | Klemm et al. . | |
| 4,692,277 | 9/1987 | Siklosi . | |
| 4,758,641 | 7/1988 | Hsu . | |
| 4,797,310 | 1/1989 | Barby et al. . | |
| 4,802,997 | 2/1989 | Fox et al. . | |
| 4,806,254 | 2/1989 | Church . | |
| 4,849,257 | 7/1989 | Borcher et al. . | |
| 4,886,615 | 12/1989 | Dehan . | |
| 4,909,962 | 3/1990 | Clark . | |
| 4,943,392 | 7/1990 | Hastedt et al. . | |
| 4,966,724 | 10/1990 | Culshaw et al. . | |
| 4,983,317 | 1/1991 | Requejo et al. . | |
| 5,004,557 | 4/1991 | Nagarajan et al. . | |
| 5,009,747 | 4/1991 | Viazmensky et al. | 162/115 |
| 5,041,230 | 8/1991 | Borcher et al. . | |
| 5,062,973 | 11/1991 | Kellett . | |
| 5,080,822 | 1/1992 | VanEenam . | |
| 5,102,573 | 4/1992 | Han et al. . | |
| 5,112,358 | 5/1992 | Deal . | |
| 5,173,200 | 12/1992 | Kellett . | |
| 5,213,624 | 5/1993 | Williams . | |
| 5,238,587 | 8/1993 | Smith et al. | 510/277 |
| 5,547,476 | 8/1996 | Siklosi et al. | 8/142 |
| 5,591,236 | 1/1997 | Roetker et al. | 8/137 |
| 5,630,847 | 5/1997 | Roetker et al. | 8/137 |
| 5,630,848 | 5/1997 | Young et al. | 8/137 |
| 5,632,780 | 5/1997 | Siklosi | 8/137 |

FOREIGN PATENT DOCUMENTS

| | | |
|---|---|---|
| 1005204 | 2/1977 | Canada . |
| 0 213 500 | 3/1987 | European Pat. Off. . |
| 0 261 718 | 3/1988 | European Pat. Off. . |
| 0 429 172 A1 | 5/1991 | European Pat. Off. . |
| 1397475 | 6/1975 | United Kingdom . |
| 1598911 | 9/1981 | United Kingdom . |
| WO 91/09104 | 6/1991 | WIPO . |
| WO 91/13145 | 9/1991 | WIPO . |
| WO 93/25654 | 12/1993 | WIPO . |

OTHER PUBLICATIONS

Hunt, D.G. and N.H. Morris, "PnB and DPnB Glycol Ethers", *HAPPI*, Apr. 1989, pp. 78–82. (Month Unknown).

*Primary Examiner*—Alan Diamond
*Attorney, Agent, or Firm*—Jerry J. Yetter; Jacobus C. Rasser

[57] ABSTRACT

A dry cleaning process is conducted in a hot air clothes dryer using a containment bag. The bag is constructed using heat resistant polymers, such as nylon, to avoid unanticipated hot spots in the dryer. The bag retains its integrity and can be re-used in subsequent dry cleaning operations.

7 Claims, 1 Drawing Sheet

HEAT RESISTANT DRY CLEANING BAG

FIELD OF THE INVENTION

The present invention relates to fabric dry cleaning which is conducted in a bag-type container in a hot air environment.

CROSS REFERENCE

This application claims priority under Title 35, United States Code 119(e) from Provisional Application Ser. No. 60/002,167, filed Aug. 11, 1995 and Provisional Application Ser. No. 60/005,684, filed Oct. 17, 1995.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes. Accordingly, it would be of considerable benefit to consumers to provide non-immersion dry cleaning processes which can be used in the home.

One type of home dry cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package.

The present invention is directed to the solution of a problem which appears to have been heretofore unrecognized in the home dry cleaning field. It has now been discovered that some conventional laundry dryers, which otherwise appear to be functioning quite normally, can reach air and surface temperatures which exceed the expected norms for this type of appliance. Specifically, air temperatures in various regions of the dryer drum can reach 250° F. (121° C.) to 300° F. (149° C.), and surface temperatures of 350° F. (177° C.) to 400° F. (204° C.) have been recorded. Such hot spot temperatures are very much higher, e.g., 100°–250° F. (39°–120° C.) than the programmed operating temperatures used in conventional dryers. This situation appears to be surprisingly wide-spread and seems to affect 5–10% of the dryers which have been investigated. Upon due consideration, the development of such hot spots can be presumed to result from poor dryer venting, clogged lint filters, malfunctioning temperature sensors, or combinations of such factors. Whatever the reason, the development of such high temperatures has now been found to cause unacceptable melting or fusing of conventional plastic bags used for in-home dry cleaning. Such bags are then rendered unacceptable for multiple uses. In extreme circumstances, loss of bag integrity can subject garments to unacceptably high temperatures. By the practice of the present invention, dry cleaning bags comprising a heat-resistant polymer such as nylon are used to overcome this problem. Importantly, this allows the bag to be re-used in subsequent dry-cleaning operations.

BACKGROUND ART

Dry cleaning processes are disclosed in: EP 429,172A1, published 29.05.91, Leigh, et at.; and in U.S. Pat. No. 5,238,587, issued Aug. 24, 1993, Smith, et at. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP0 261 718; G.B. 1,397,475; WO 91/09104; WO 91/13145; WO 93/25654 and Hunt, D. G. and N. H. Morris, "PnB and DPnB Glycol Ethers", HAPPI, Apr. 1989, pp. 78–82.

SUMMARY OF THE INVENTION

The present invention encompasses a process for cleaning fabrics in a conventional automatic clothes dryer, comprising the steps of placing soiled fabrics in a flexible containment bag together with a cleaning composition, sealing said bag, placing said bag in the drum of the clothes dryer and operating the dryer under conventional usage conditions involving rotation of the dryer drum and the introduction of hot air into the drum, which comprises the improvement wherein said bag is constructed of a polymer which is a member selected from the group consisting of nylon (preferred) and polyester, and combinations thereof, whereby melting of said bag by the presence of unanticipated hot spots in said dryer is avoided.

In a preferred process herein, a carrier is used to releasably contain the cleaning composition. A preferred carrier herein comprises a sheet of hydroentangled fibers. Cellulose sheets in the manner of disposable paper towels, and the like, can also be used as a carrier.

In another preferred aspect, the cleaning composition used in the present invention comprises a member selected from the group consisting of methoxy-, ethoxy-, propoxy- and butoxy-propoxy propanol. In yet another aspect, the cleaning composition comprises 1,2-octanediol. In a highly preferred aspect, the cleaning composition comprises a mixture of butoxy propoxy propanol and 1,2-octanediol.

All percentages, ratios and proportions herein are by weight, unless otherwise specified. All documents cited are, in relevant part, incorporated herein by reference.

DETAILED DESCRIPTION OF THE INVENTION

Figure 1:
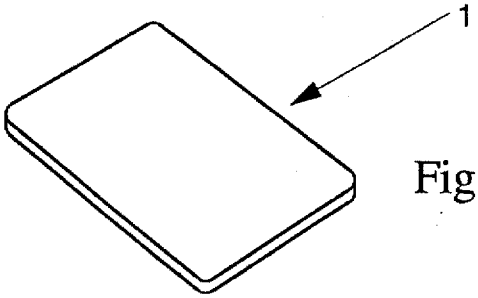
FIG. 1 is a perspective of a cleaning sheet of the type used herein.

Containment Bag—The construction of the flexible bag used herein uses thermal resistant films to provide the needed temperature resistance to internal self-sealing and external surface deformation now found to be caused by overheated clothes dryers. In addition, the bags are resistant to the chemical agents used in the cleaning compositions herein and substantially impermeable to their vapors and to water vapor. By proper selection of bag material, unacceptable results such as bag melting, melted holes in bags, and sealing of bag wall-to-wall are avoided. In a preferred mode, the closure means for the bag is also constructed of a thermal resistant material.

The dimensions of the containment bag can vary, depending on the intended end-use. For example, a bag can be provided which is sufficient to contain one or two silk blouses. Alternatively, a bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 1–5 kg) without being so large as to block dryer vents.

The bag herein is preferably flexible, yet is preferably durable enough to withstand multiple uses. Typically, such bags are prepared from 0.0025 mm to 0.0075 mm (1–3 mil) thickness polymer sheets. If some rigidity in the bag is desired, somewhat thicker sheets can be used.

In a preferred embodiment, 0.0025 mm to 0.0075 mm nylon film is sealed into a 26 inch (66 cm)×30 in. (76 cm) bag in the manner shown in the Figures. Sealing is preferably done using standard impulse heating equipment. In an alternate mode, a sheet of nylon is simply folded in half and sealed along two of its edges. In yet another mode, bags can be made by air blowing operations.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.).

Cleaning Compositions—The chemical compositions which are used to provide the cleaning function in the present process comprise ingredients which are safe and effective for their intended use. Since the process herein does not involve an aqueous rinse step, the cleaning compositions employ ingredients which do not leave undesirable residues on fabrics when employed in the manner disclosed herein. While conventional laundry detergents are typically formulated to provide good cleaning on cotton and cotton/polyester blend fabrics, the cleaning compositions herein must be formulated to also safely and effectively clean and refresh fabrics such as wool, silk, rayon, rayon acetate, and the like.

In addition, the cleaning compositions herein comprise ingredients which are specially selected and formulated to minimize dye removal from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred cleaning compositions herein are formulated to minimize or avoid this problem.

The dye removal attributes of the present cleaning compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner using an absorbent, white paper hand towel. Hand pressure is applied, and the amount of dye which is transferred onto the white towel is assessed visually. Numerical units ranging from: (1) "I think. I see a little dye on the towel"; (2) "I know I see some dye on the towel"; (3) I see a lot of dye on the towel"; through (4) "I know I see quite a lot of dye on the towel" are assigned by panelists.

In addition to the foregoing considerations, the cleaning composition herein is preferably formulated such that it is not so adhesive in nature that it renders the device unhandy or difficult to use. However, and while not intending to be limiting of the present invention, the preferred cleaning compositions disclosed herein afford a spot-cleaning process which is both effective and aesthetically pleasing when used with a device according to this invention. Having due regard to the foregoing considerations, the following illustrates the ingredients used in the cleaning compositions herein, but is not intended to be limiting thereof.

(a) Solvent—The compositions will preferably comprise at least about 4%, typically from about 5% to about 25%, by weight, of organic solvent. The objective is to provide at least about 0.4 g, preferably from about 0.5 g to about 2.5 g, of solvent per kg of fabrics being cleaned.

(b) Emulsifier—The compositions will comprise sufficient emulsifier to provide a stable, homogeneous composition comprising components (a), (b) and (d). For the preferred emulsifiers disclosed hereinafter, levels as low as 0.05%, preferably 0.07% to about 0.20%, by weight, are quite satisfactory. If less efficient emulsifiers are used, levels up to about 2%, by weight, can be used, but may leave some noticeable residues on the fabrics.

(c) Water—The compositions will comprise at least about 60%, typically from about 80% to about 95%, by weight, of water. Stated otherwise, the objective is to provide at least about 6 g of water per kg of fabrics being cleaned.

(d) Optionals—The compositions herein may comprise various optional ingredients, including perfumes, conventional surfactants, and the like. If used, such optional ingredients will typically comprise from about 0.1% to about 10%, by weight, of the compositions, having due regard for residues on the cleaned fabrics.

It has now been determined that 1,2-octanediol ("OD") affords special advantages in the formulation of the cleaning compositions herein. From the standpoint of aesthetics, OD is a relatively innocuous and low odor material. Moreover, OD appears to volatilize from fabric surfaces without leaving visible residues. This is especially important in a dry cleaning process of the present type which is conducted without a rinse step. From the performance standpoint, OD appears to function both as a solvent for greasy/oily stains and as what might be termed a "pseudo-surfactant" for particulate soils and water-soluble stains. Whatever the physical-chemical reason, OD has now been found to be a superior wetting agent with respect to both cleaning and ease-of-use in the present context of home-use cleaning compositions and processes. If used, OD will comprise at least about 0.05%, typically from about 0.1% to about 1.5%, by weight of the cleaning compositions herein.

A preferred solvent herein is butoxy propoxy propanol (BPP) which is available in commercial quantities as a mixture of isomers in about equal amounts. The isomers, and mixtures thereof, are useful herein. The isomer structures are as follows:

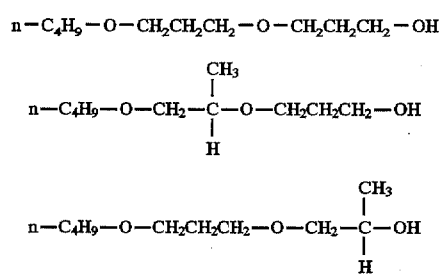

BPP is outstanding for cleaning, and is so effective that it allows the amount of the relatively expensive 1,2-octanediol to be minimized. Moreover, it allows for the formulation of effective cleaning compositions herein without the use of conventional surfactants. Importantly, the odor of BPP is of a degree and character that it can be relatively easily masked by conventional perfume ingredients. While BPP is not completely miscible with water and, hence, could negatively impact processing of the cleaning compositions herein, that potential problem has been successfully overcome by means of the PEMULEN-type polyacrylate emulsifiers, as disclosed hereinafter.

The BPP solvent used herein is preferably a mixture of the aforesaid isomers. In a preferred mode, the cleaning compositions comprise a mixture of the 1,2-octanediol and BPP, at a weight ratio of OD:BPP in the range of from about 1:250 to about 2:1, preferably from about 1:200 to about 1:5.

A highly preferred emulsifier herein is commercially available under the trademark PEMULEN, The B. F. Goodrich Company, and is described in U.S. Pat. Nos. 4,758,641 and 5,004,557, incorporated herein by reference. PEMULEN polymeric emulsifiers are high molecular weight polyacrylic acid polymers. The structure of PEMULEN includes a small portion that is oil-loving (lipophilic) and a large water-loving (hydrophilic) portion. The structure allows PEMULEN to function as a primary oil-in-water emulsifier. The lipophilic portion adsorbs at the oil-water interface, and the hydrophilic portion swells in the water forming a network around the oil droplets to provide emulsion stability. An important advantage for the use of such polyacrylate emulsifiers herein is that cleaning compositions can be prepared which contain solvents or levels of solvents that are otherwise not soluble or readily miscible with water. A further advantage is that effective emulsification can be accomplished using PEMULEN-type emulsifier at extremely low usage levels (0.05–0.2%), thereby minimizing the level of any residue left on fabrics following product usage. For comparison, typically about 3–7% of conventional anionic or nonionic surfactants are required to stabilize oil-in-water emulsions, which increases the likelihood that a residue will be left on the fabrics. Another advantage is that emulsification (processing) can be accomplished effectively at room temperature.

While the cleaning compositions herein function quite well with only the 1,2-octanediol, BPP, PEMULEN and water, they may also optionally contain detersive surfactants to further enhance their cleaning performance. While a wide variety of detersive surfactants such as the $C_{12}$–$C_{16}$ alkyl sulfates and alkylbenzene sulfonates, the $C_{12}$–$C_{16}$ ethoxylated (EO 0.5–10 avg.) alcohols, the $C_{12}$–$C_{14}$ N-methyl glucamides, and the like can be used herein, it is highly preferred to use surfactants which provide high grease/oil removal. Included among such preferred surfactants are the $C_{12}$–$C_{16}$ alkyl ethoxy sulfates (AES), especially in their magnesium salt form, and the $C_{12}$–$C_{16}$ dimethyl amine oxides. Especially preferred mixtures comprise $MgAE_1S$/$MgAE_{6.5}S$/$C_{12}$ dimethyl amine oxide, at a weight ratio of about 1:1:1, and $MgAE_1S$/$C_{12}$ dimethyl amine oxide at a 2:1 weight ratio. If used, such surfactants will typically comprise from about 0.05% to about 2.5%, by weight, of the cleaning compositions herein.

In addition to the preferred solvents and emulsifiers disclosed above, the cleaning compositions herein may comprise various optional ingredients, such as perfumes, preservatives, co-solvents, brighteners, salts for viscosity control, pH adjusters or buffers, anti-static agents such as VERSAFLEX 157 or VERSAFLEX 2004 from National Starch Company, softeners, colorants, mothproofing agents, insect repellents, and the like. Enzymes such as proteases, lipases, amylases and mixtures thereof can also be used at levels from about 0.0001% to about 1% of the compositions. The following illustrates preferred ranges for cleaning compositions for use herein, but is not intended to be limiting thereof.

| Ingredient | % (wt.) Formula Range |
|---|---|
| BPP* | 5–25% |
| 1,2-Octanediol | 0.1–7% |
| $MgAE_1S$ | 0.01–0.8% |

-continued

| Ingredient | % (wt.) Formula Range |
|---|---|
| $MgAE_{6.5}S$ | 0.01–0.8% |
| $C_{12}$ Dimethyl Amine Oxide | 0.01–0.8% |
| PEMULEN** | 0.05–0.20% |
| Ethoxylated Alcohol*** | 0.1–2.5% |
| Perfume | 0.01–1.5% |
| Water | Balance |
| pH range from about 6 to about 8. | |

Other solvents or co-solvents which can be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and PPP, and the like, and mixtures thereof. Indeed, although somewhat less preferred, the MPP, EPP and PPP, respectively, can replace the BPP solvent in the foregoing cleaning compositions. The levels of these solvents, and their ratios with 1,2-octanediol, are the same as with the preferred BPP solvent. If desired, and having due regard for safety and odor for in-home use, various conventional chlorinated and hydrocarbon dry cleaning solvents may also be used. Included among these are 1,2-dichloroethane, trichloroethylene, isoparaffins, and mixtures thereof.
**As disclosed in U.S. Pat. Nos. 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 200,000 to 5,000,000.
***$C_{12}$–$C_{13}$ alcohol with about 6.5 EO's is preferred; available as Neodol from Shell.

Excellent cleaning performance is secured using any of the foregoing non-immersion processes and articles to provide from about 3 g to about 50 g of the cleaning compositions per kg of fabric being cleaned.

Carrier—When used in a dry cleaning operation of the present type, the foregoing cleaning compositions are preferably used in combination with a carrier, such that the cleaning composition performs its function as the surfaces of the fabrics being cleaned come in contact with the surface of the carrier. The carrier releasably contains the cleaning composition. By "releasably contains" means that the cleaning composition is effectively released from the carrier onto the soiled fabrics as part of the dry cleaning process herein.

The carrier can be in any desired form, such as powders, flakes, shreds, and the like. However, it will be appreciated that such comminuted carriers would have to be separated from the fabrics at the end of the cleaning process. Accordingly, it is highly preferred that the carrier be in the form of an integral pad or sheet which substantially maintains its structural integrity throughout the cleaning process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-tinting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being cleaned is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (X-direction) of from about 20 cm to about 35 cm, and (Y-direction) of from about 18 cm to about 45 cm.

The carrier is intended to contain a sufficient amount of the cleaning composition to be effective for its intended purpose. The capacity of the carrier for the cleaning composition will vary according to the intended usage. For example, carrier/cleaning composition pads or sheets which are intended for a single use will require less capacity than such pads or sheets which are intended for multiple uses. For a given type of carrier the capacity for the cleaning composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 min. Of course, the foregoing dimensions may vary, as long as the desired quantity of the cleaning composition is effectively provided by means of the carrier.

The preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. Nos. 5,009,747, Viazmensky, et al., Apr. 23, 1991 and 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | gm/m$^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | gm/cm$^2$ | 1050 | 700–1200 |

*MD—machine direction; CD—cross direction

As disclosed in U.S. Pat Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning compositions herein, but actually optimizes cleaning performance. While not intending to be limited by theory, it may be speculated that this carrier is more effective in delivering the cleaning composition to soiled fabrics. Or, this particular carrier might be better for removing soils by contact with the soiled fabrics, due to its mixture of fibers. Whatever the reason, improved dry cleaning performance is secured.

In addition to the improved cleaning performance, it has now been discovered that this hydroentangled carrier material provides an additional, unexpected benefit due to its resiliency. In-use, the dry cleaning sheets herein are designed to function in a substantially open configuration. However, the sheets are packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this newly-discovered and unexpected attribute of the carrier materials herein makes them optimal for use in the manner of the present invention.

Process—The present cleaning process using the thermally stable containment bag is conducted in a tumbling apparatus in the presence of heat. In a convenient mode a container bag with the carrier/cleaning composition and enveloping the soiled fabric is sealed and placed in the drum of an automatic hot air clothes dryer. The drum is allowed to revolve, which imparts a tumbling action to the bag and agitation of its contents concurrently with the tumbling. By virtue of this agitation, the fabrics come in contact with the carrier containing the cleaning composition. The tumbling and heating are carried out for a period of at least about 10 minutes, typically from about 20 minutes to about 30 minutes. The process can be conducted for longer or shorter periods, depending on such factors as the degree and type of soiling of the fabrics, the nature of the soils, the nature of the fabrics, the fabric load, the amount of heat applied, and the like, according to the needs of the user.

EXAMPLE I

A dry cleaning article in sheet form is assembled using a sheet substrate and a cleaning composition prepared by admixing the following ingredients.

| Ingredient | % (wt.) |
|---|---|
| BPP* | 7.0 |
| 1,2-octanediol | 0.5 |
| PEMULEN TR-1** | 0.125 |
| KOH | 0.08 |
| Perfume | 0.75 |
| Water and minors*** | Balance |

*Isomer mixture; available from Dow Chemical Co.
**PEMULEN TR-2, B. F. Goodrich, may be substituted.
***Includes preservatives such as KATHON ®.

A non-linting carrier sheet is prepared using stock HYDRASPUN® Grade 10244 fabric, described above. The fabric is cut into square carrier sheets, approximately 9 in (22.9 cm)×10 in (25.4 cm), i.e., 580.6 cm$^2$ sheets.

23 Grams of the above-noted cleaning composition are evenly applied to the sheet by spreading onto the sheet with a roller or spatula using hand pressure. In an alternate mode, the cleaning composition can be applied by dipping or spraying the composition onto the substrate, followed by squeezing with a roller or pair of nip rollers, i.e., by "dip-squeezing" or "spray squeezing". The external surfaces of the sheet are damp but not tacky to the touch. The finished sheet can be folded for packaging, and when unfolded and used in the manner disclosed herein, the sheet remains in the desired unfolded configuration.

EXAMPLE II

The following illustrates a typical process herein using the containment bag herein, but is not intended to be limiting thereof.

Figure 2:
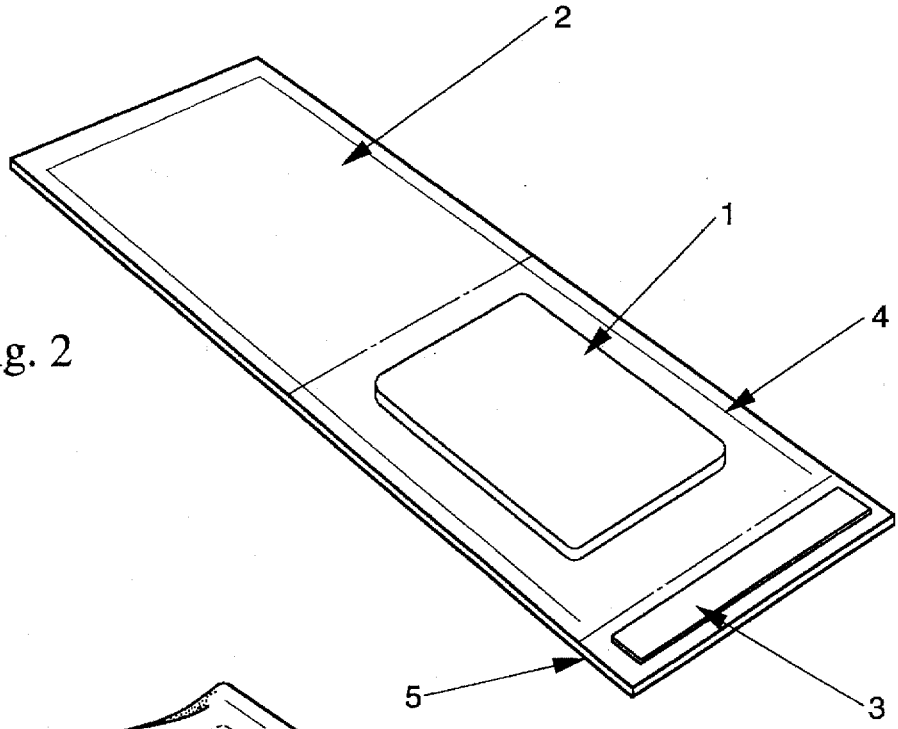
FIG. 2 is a perspective of a cleaning sheet loosely resting on a containment bag which is in a pre-folded condition.
Figure 3:
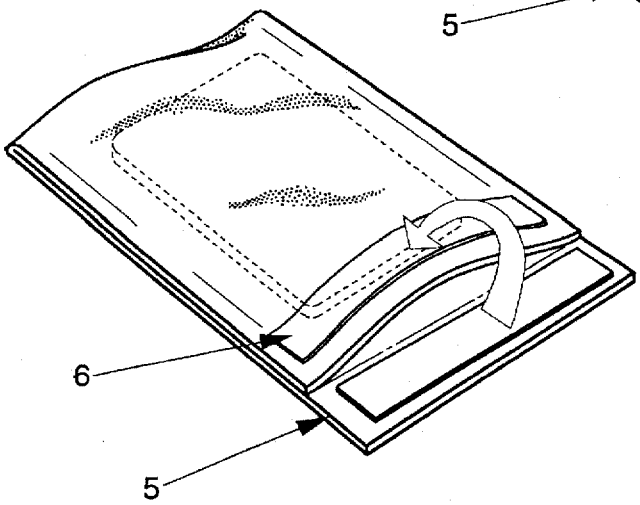
FIG. 3 is a perspective of the sheet within the bag which is ready to receive the fabrics to be dry cleaned in a hot air dryer.

As shown in FIG. 2, a flat sheet (2) of flexible nylon polymer with a patch of Velcro®-type fastener (3) is assembled. In an alternate mode, a nylon zipper or Zip-Lok® type closure means as well as contact adhesive or simple ties can be used. A containment bag is formed by folding the sheet and bonding along border (4). As shown in FIG. 3, closure flap (5) with sealing means (3) allows closing and sealing of the bag by imposing sealing means (3) onto contact surface (6). In a typical mode, a sheet (1) of the type described in Example I is placed in the plastic bag having a volume of about 25,000 cm$^3$, as shown in FIG. 3. Up to about 2 kg of dry garments to be cleaned are then placed in the bag. When the garments and the dry cleaning sheet are placed in the bag, the air is preferably not squeezed out of the bag before closing and sealing. This allows the bag to billow, thereby providing sufficient space for the fabrics and cleaning sheet to tumble freely together. The bag is then closed, sealed and placed in a conventional hot-air clothes dryer. The dryer is started and the bag is tumbled for a period of 20–30 minutes at a dryer air temperature in the range from about 50° C. to about 400° C. During this time, the sheet comes into close contact with the fabrics. After the machine cycle is complete, the bag and its contents are removed from the dryer, and the spent dry cleaning sheet is discarded. The nylon bag is retained for re-use. The bag retains its integrity even at the highest temperatures in the range and can be re-used 5–10 times, or more. The fabrics are cleaned and refreshed. The water present in the cleaning composition serves to minimize wrinkles in the fabrics.

In an alternate mode, heavily soiled areas of the fabric being cleaned can optionally be pre-treated by pressing or rubbing a fresh dry cleaning sheet according to this invention on the area. The sheet and pre-treated fabric are then placed in the nylon bag, and the dry cleaning process is conducted in the manner described herein.

EXAMPLE III

The following illustrates a typical dry cleaning kit herein, but is not intended to be limiting thereof.

A dry cleaning kit is assembled packaging multiple (typically, 5–10) single use dry cleaning sheets of the type described herein together with a sealable, reusable nylon container bag, in a package comprising a conventional cardboard box suitable for retail sales.

EXAMPLE IV

A dry cleaning composition with reduced tendency to cause dye "bleeding" or removal from fabrics as disclosed above is as follows.

| INGREDIENT | PERCENT (wt.) | (RANGE) |
|---|---|---|
| Butoxypropoxy propanol (BPP) | 7.000 | 4.0–25.0% |
| NEODOL 23 - 6.5* | 0.750 | 0.05–2.5% |
| 1,2-Octanediol | 0.500 | 0.1–10.0% |
| Perfume | 0.750 | 0.1–2.0% |
| Pemulen TR-1 | 0.125 | 0.05–0.2% |
| Potassium Hydroxide (KOH) | 0.060 | 0.024–0.10 |
| Potassium Chloride | 0.075 | 0.02–0.20 |
| Water (distilled or deionized) | 90.740 | 60.0–95.0% |
| Target pH = 7.0 | | |

*Shell; $C_{12}$–$C_{13}$ alcohol, ethoxylated with average EO of 6.5.

15–25 Grams of a composition of the foregoing type are placed on a HYDRASPUN® carrier sheet for use in the manner disclosed herein.

Besides the optional nonionic surfactants used in the cleaning compositions herein, which are preferably $C_8$–$C_{18}$ ethoxylated (E01–15) alcohols or the corresponding ethoxylated alkyl phenols, the compositions can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.001%–1%, by weight.

If the compositions herein are used in a spot-cleaning mode, they are preferably pressed (not rubbed) onto the fabric at the spotted area using an applicator pad comprising looped fibers, such as is available as APLIX 200 or 960 Uncut Loop, from Aplix, Inc., Charlotte, N.C. An underlying absorbent sheet or pad of looped fibers can optionally be placed beneath the fabric in this mode of operation.

What is claimed is:

1. In a process for cleaning fabrics in an otherwise conventional automatic clothes dryer wherein said dryer may unintentionally exhibit localized surface hot spots as high as about 204° C., comprising the steps of placing soiled fabrics in a flexible containment bag together with a cleaning composition, placing said bag in the drum of the clothes dryer and operating the dryer under conventional usage conditions involving rotation of the dryer drum and the introduction of hot air into the drum, the improvement wherein said bag is constructed of a polymer which is a member selected from the group consisting of nylon, polyester, and combinations thereof, which are heat resistant at least to about 204° C., whereby melting of said bag by the presence of said surface hot spots in said dryer is avoided.

2. A process according to claim 1 wherein a carrier releasably contains the cleaning composition.

3. A process according to claim 2 wherein the carrier comprises a sheet of hydroentangled fibers.

4. A process according to claim 1 wherein the cleaning composition comprises a member selected from the group consisting of methoxy-, ethoxy-, propoxy- and butoxypropoxy propanol.

5. A process according to claim 1 wherein the cleaning composition comprises 1,2-octanediol.

6. A process according to claim 1 wherein the cleaning composition comprises a mixture of butoxy propoxy propanol and 1,2-octanediol.

7. A process according to claim 6 wherein the bag is nylon.

* * * * *